US006832904B2

(12) United States Patent
Turner et al.

(10) Patent No.: US 6,832,904 B2
(45) Date of Patent: Dec. 21, 2004

(54) APPARATUS FOR COOLING AND FINISHING MELT-SPUN FILAMENTS

(75) Inventors: Terence Ernest Turner, Fort Mill, SC (US); Jeffrey Emmett Stine, Charlotte, NC (US); Sidney Henry Goode, Auburn, AL (US)

(73) Assignee: Wellman, Inc., Shrewsbury, NJ (US)

( * ) Notice: Subject to any disclaimer, the term of this patent is extended or adjusted under 35 U.S.C. 154(b) by 323 days.

(21) Appl. No.: 10/219,184

(22) Filed: Aug. 15, 2002

(65) Prior Publication Data

US 2004/0032048 A1 Feb. 19, 2004

(51) Int. Cl.[7] ..... D01D 5/088
(52) U.S. Cl. ..... 425/72.2; 425/94
(58) Field of Search ..... 425/72.2, 94, 104

(56) References Cited

U.S. PATENT DOCUMENTS 4,038,357 A * 7/1977 Boyes et al. ..... 264/211.15
4,288,207 A * 9/1981 Wilkes ..... 425/72.2
4,988,270 A 1/1991 Stibal et al.
4,990,297 A 2/1991 Stibal et al.
5,536,157 A 7/1996 Linz
5,866,055 A 2/1999 Schwarz et al.
6,174,474 B1 1/2001 Stein et al.

* cited by examiner

*Primary Examiner*—James P. Mackey
(74) *Attorney, Agent, or Firm*—Summa & Allan, P.A.

(57) ABSTRACT

A hollow quench stick tube capable of cooling and finishing melt-spun filaments comprises in one embodiment a hollow cooling tube connected to a hollow support tube, a finish applicator that substantially surrounds the hollow support tube, and a spoiler skirt that substantially surrounds the hollow cooling tube and that is spaced apart from the finish applicator to define a spoiler void. In operation, the spoiler skirt diverts a flow of air to create a partial vacuum in the spoiler void that draws a filament stream inwardly against the finish applicator.

52 Claims, 3 Drawing Sheets

APPARATUS FOR COOLING AND FINISHING MELT-SPUN FILAMENTS

FIELD OF THE INVENTION

The invention relates to an apparatus for cooling and finishing melt-spun filaments. In particular, the invention relates to a hollow quench stick tube that incorporates a spoiler skirt and a finish applicator that are spaced apart to form a spoiler void. The spaced arrangement of the spoiler skirt and finish applicator facilitates the creation of a partial vacuum in the spoiler void to draw a filament stream inwardly against the finish applicator such that the individual filaments are stabilized and sufficiently lubricated with a desired finishing agent. In another aspect, the invention is a method for cooling and finishing melt-spun filaments that incorporates the apparatus wherein the filament stream is drawn inwardly against the finish applicator.

BACKGROUND OF THE INVENTION

The process in which a fiber-forming substance is melted and then extruded into air or other gas where the substance is cooled and solidified is known as melt spinning. Melt spinning is typically used for the manufacture of polyester and nylon. Various apparatus and methods exist for cooling and finishing melt-spun filaments. Existing apparatus incorporate spinnerets for extruding the filament, cooling tubes for lowering the temperature of the melt-spun filaments as they exit the spinneret, finish applicators for applying desired finishing agents, and filament guides for directing the filament stream towards the finish applicator and onto wind-up units for collecting the finished filament.

The finishing process, whereby finishing agents are applied to the cooled filaments, is a critical aspect of the melt-spinning process. Specifically, filaments are coated with a desired finishing agent, for example, a lubricating agent, to ensure that the structure of the filaments is not damaged during processing. Damaged filaments are not suitable for use in later processes. Existing apparatus address the problem of applying a sufficient amount of desired finishing agent to filaments. Specifically, known devices incorporate complex mechanisms for delivering the finishing agent and convergence devices for drawing individual filaments into a single thread. Unfortunately, these known devices are prone to mechanical failure (e.g., valve failure and clogging) and place additional, potentially damaging, strain on the individual filaments forming the filament stream.

For example, U.S. Pat. No. 5,886,055 to Schwarz discloses an apparatus and process for producing polyester multifilament yarn. Schwarz discloses a cooling tube for dispersing air against a filament stream, a downstream sealed tube connected to the cooling tube, a finish applicator connected to the lower end of the sealed tube, and a conical mantle that optionally encloses the sealed tube. As described, Schwarz relies on a convergence device to direct the filament stream against the finish applicator and to combine the individual filaments into one thread. Thus, Scwharz depends upon the convergence device to ensure that the individual filaments contact the finish applicator. Nevertheless, existing convergence devices fail to adequately control the lateral movement (i.e., oscillation) of upstream sections of the filament stream that are adjacent the finish applicator. In other words, known convergence devices affect the downstream sections of the filament stream, yet fail to prevent lateral movement of upstream sections of the filament stream, and specifically, upstream sections affected by air drawn downwardly by the filament stream (i.e., entrained air). Thus there exists a need for an apparatus and method that controls the lateral movement of the filament stream adjacent the finish applicator.

U.S. Pat. No. 6,174,474 B1 to Stein describes an apparatus and method for producing microfilament yarns with increased titer uniformity. Stein discloses a cone-shaped filament guide secured to a downstream section of a cooling tube that directs air against a filament stream to prevent contact between the filaments and filament guide. The cone-shaped filament guide accelerates entrained air and creates an air cushion that prevents filaments from contacting the filament guide and damaging the filament structure. Stein further discloses finish applicators that are separate from (i.e., not connected to) the cooling tube. Although the cone-shaped filament guide of Stein addresses the problem of preventing the oscillation of filaments at an upstream portion of the filament stream (i.e., prevent contact with the filament guide), it fails to address the problem of ensuring the application of sufficient finishing agent to the individual filaments. Rather, Stein positions the finish applicator below the cooling tube and incorporates the finish applicator as a convergence device. Unfortunately, the separation of the finish applicator from the cooling tube increases the amount of space required to operate the apparatus. Accordingly, there exists a need for a cooling and finishing apparatus in which the cooling tube and finish applicator are integrated and require less space during operation.

U.S. Pat. No. 4,988,270 to Stibal discloses an apparatus for cooling and conditioning melt-spun material. The Stibal devise includes a dispersing head, a multi-channel finish applicator, and a baffled opening at a downstream section of the dispersing head. Stibal relies upon a mechanically complicated valve seat, valve closure, and spike adjacent the upper end of the dispersing head to create an area of negative pressure to draw filaments into contact with the finish applicator. The valves and valve seats are prone to mechanical breakdown that results in downtime for maintenance periods. Thus, there exists a need for a mechanically reliable apparatus for cooling and finishing melt-spun filaments.

Existing methods for cooling and finishing filaments as disclosed in the above patents incorporate the devices described therein. Accordingly, there exists a need for a method of cooling and finishing filaments that control filament oscillation adjacent the finish applicator and that incorporates mechanically reliable apparatus.

SUMMARY OF THE INVENTION

It is therefore an object of the present invention to provide an apparatus and method for cooling and finishing melt-spun filaments that controls the lateral movement of the filament stream adjacent the finish applicator.

Yet another object of the invention is the provision of an apparatus and method for cooling and finishing melt-spun filaments that includes an integrated cooling tube and finish applicator to minimize the space required during operation.

A further object of the invention is the provision of an apparatus and method for cooling and finishing melt-spun filaments that is mechanically reliable and reduces the amount of downtime required for maintenance.

Still another object of the invention is the provision of a method of cooling and finishing melt-spun filaments that controls filament oscillation adjacent the finish applicator and that incorporates mechanically reliable apparatus.

The invention meets these objectives with an apparatus for cooling and finishing melt-spun filaments. In particular, the invention is a hollow quench stick tube, a finish applicator that substantially surrounds the hollow quench stick tube, and a spoiler skirt that substantially surrounds the hollow quench stick tube and that is spaced apart from the finish applicator to define a spoiler void. In another aspect, the invention is a method for cooling and finishing melt-spun filaments that incorporates the apparatus wherein a partial vacuum created in the spoiler void draws the filaments inwardly against the finish applicator.

The foregoing and other objects and advantages of the invention and the manner in which the same are accomplished will become clearer based on the following detailed description taken in conjunction with the accompanying drawings in which:

DETAILED DESCRIPTION OF THE INVENTION

Figures 1, 2, 3:
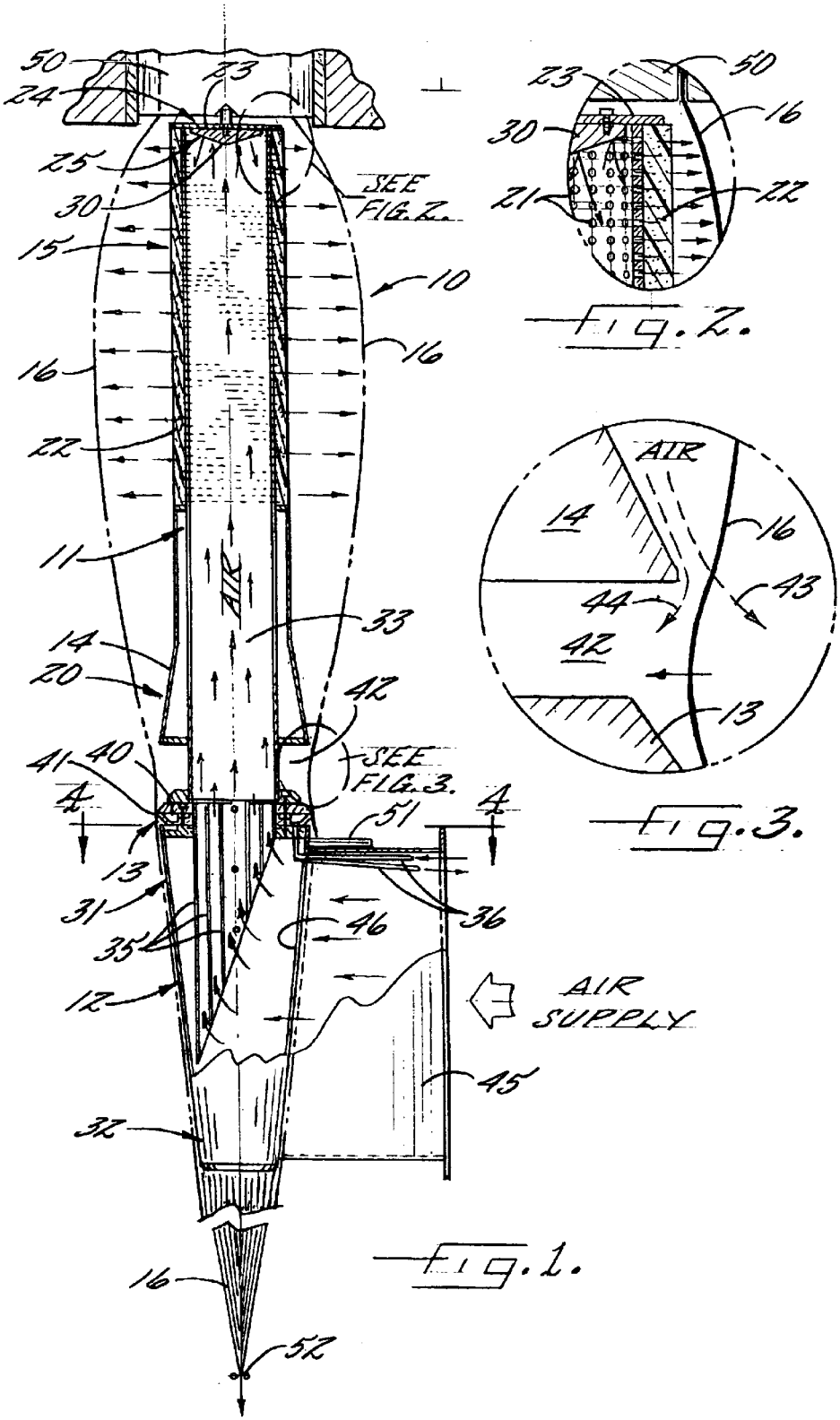
FIG. 1 is a side view of a preferred embodiment of the hollow quench stick tube formed of a hollow cooling tube and a hollow support tube that illustrates air from an air supply entering the hollow support tube, flowing upwardly into the hollow cooling tube, exiting the hollow cooling tube, and flowing against a filament stream.
FIG. 2 is an enlarged detailed sectional view of an upper end of the hollow cooling tube depicting flowing air exiting a plurality of openings defined by the hollow cooling tube and cooling the filament stream.
FIG. 3 is an enlarged detailed sectional view of a spoiler skirt deflecting the flowing air and creating a partial vacuum in a spoiler void.

The present invention will now be described more fully hereinafter with reference to the accompanying drawings, in which a preferred embodiment of the invention is shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood to those skilled in the art that the concept of an element being "adjacent" another element does not necessarily imply that the elements are contiguous (i.e., in intimate contact). Rather, as used herein, the concept of an element being adjacent another element is meant to describe the relative positions of the elements wherein the elements are in close proximity. Furthermore, it will be understood that the concept of one element being adjacent another element does not necessarily imply contact, but may imply absence of anything of the same kind between the elements.

It will be understood that the term "spoiler void" refers to a space defined by the maximum diameter of the spoiler skirt, the maximum diameter of the finish applicator, and the periphery of the hollow quench stick tube.

It will be further understood that the term "ambient air" refers to the air existing or present on all sides of the quench stick tube.

It will be appreciated by those skilled in the art that the term "pressure differential" refers to the difference in standard atmospheric pressure expressed in millibars between one area and an adjacent area. Further it will be understood that the term "partial vacuum" refers to a defined space having a pressure below atmospheric pressure.

As used herein, it will be further understood that the term "sleeve" refers to a tubular element that is capable of fitting over or substantially surrounding another element.

It will also be understood by those skilled in the art that the term "periphery" refers to the external boundary or surface of a body.

Further, the term "diameter" refers to the distance of a straight-line segment passing through the center of a body.

It will be also understood that the term "entrained air" refers to air that is drawn downwardly by the downwardly moving filament stream.

The term "angle of deflection" refers to the angle between a vertical line drawn from the outermost diameter of the top of the spoiler skirt to the bottom of the spoiler skirt and a line drawn from the outermost diameter of the top of the spoiler skirt to the outermost diameter of the spoiler skirt body. Stated differently, the angle of deflection refers to the angle defined by a line representing the height of the spoiler skirt and a line representing the outermost side of the spoiler skirt body.

As used herein, it will be understood that the term "finishing" refers to the processes through which a filament is passed after extruding and cooling in preparation for incorporation into later processes. It will also be understood by those skilled in the art that finishing includes such operations as the application of chemicals that change the character of the filament.

Further, as used in conjunction with the term "agent", "finishing agent" will be understood by those skilled in the art to refer to the chemicals used in the finishing processes (e.g., lubricants).

It will be further appreciated by those of ordinary skill in the art that, as used herein, the concept of an element "substantially surrounding" another element does not necessarily imply that the elements are contiguous (i.e., in intimate contact). Rather, as used herein, the concept of one element substantially surrounding another element is meant to describe the relative positions of the elements within the quench stick tube structure, respectively.

An overall view of the hollow quench stick tube 10 for cooling and finishing melt-spun filaments 16 that incorporates features of the present invention is set forth in FIG. 1. A preferred embodiment of the hollow quench stick tube 10 includes a hollow cooling tube 11, a hollow support tube 12, a finish applicator 13, and a spoiler skirt 14. As depicted in FIG. 1, the hollow quench stick tube 10 is formed of the hollow cooling tube 11 and the hollow support tube 12. In a preferred embodiment, the hollow quench stick tube 10 is substantially circular. As preferably configured, the hollow cooling tube 11, hollow support tube 12, finish applicator 13, and spoiler skirt 14 are coaxial.

The hollow cooling tube 11 includes an upper end 15 and a lower end 20. The hollow cooling tube 11 defines a plurality of openings 21 positioned along its periphery for dispersing a flow of supplied air. During operation, an air supply may provide the flowing air to the hollow quench stick tube 10. The plurality of openings 21 is preferably positioned above the spoiler skirt 14. It will be understood by those skilled in the art that the hollow cooling tube 11 may be formed from any material that provides uniform, non-turbulent air flow from the quench cooling tube 11 may be formed from multiple layers of mesh screen, sintered metal, or filter material sold under the trademark PORO-PLATE®.

A dispersal sleeve 22 that substantially surrounds a portion of the hollow cooling tube 11 is provided to evenly distribute flowing air exiting the plurality of openings 21. Specifically, the dispersal sleeve 22 disseminates flowing air that advances upwardly along an interior portion of the hollow quench stick tube 10 and exits from the plurality of openings 21. Advantageously, the dispersal sleeve 22 also filters airborne contaminants in the flowing air. The dispersal sleeve 22 is preferably constructed of foam that facilitates the even distribution of flowing air during operation. Nevertheless, it will be understood that the dispersal sleeve 22 may be formed from any porous media that is capable of evenly dispersing flowing air. For example, the dispersal sleeve may be formed from overlapping wire (i.e., wire mesh) woven textile material, or non-woven textile material. In a preferred embodiment, the dispersal sleeve 22 substantially surrounds an upper portion 15 of the hollow cooling tube 11 that defines the plurality of openings 21. Stated differently, the dispersal sleeve 22 may be positioned adjacent the plurality of openings 21.

Upon entry into the hollow cooling tube 11, the flowing air is collected and dispersed through the openings 21. See FIG. 2. Accordingly, the invention provides a cover plate 23 having a top surface 24 and a bottom surface 25 that is secured to the upper end 15 of the hollow cooling tube 11. As arranged, the cover plate 23 facilitates the collection of the flowing air by sealing the upper end 15 of the hollow cooling tube 11.

As shown in FIG. 1, the hollow cooling tube 11 further provides an air director 30 that is secured to the bottom surface 25 of the cover plate 23. In operation, the air director 30 is capable of deflecting flowing air that advances upwardly from the hollow support tube 12 along the hollow cooling tube 11 into the plurality of openings 21. Advantageously, the air director 30 prevents substantial fluctuations in the pressure of the flowing air in the hollow cooling tube 11. Stated differently, the air director 30 promotes a consistent pressure gradient along the length of the hollow cooling tube 11. The consistent pressure of the flowing air ensures an even distribution of the air into the plurality of openings 21 and against the filament stream 16.

Figure 4:
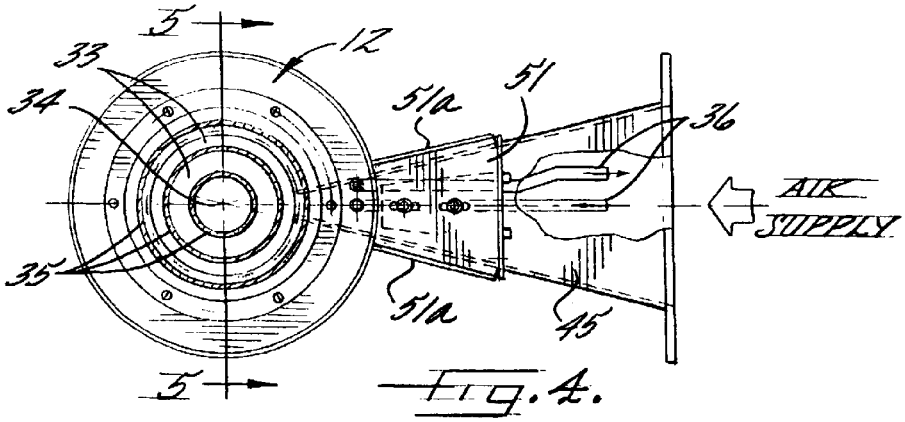
FIG. 4 is a top plan view taken generally along lines 4—4 of FIG. 1 depicting a support fin, filament guide, and channels for supplying finishing agent to the finish applicator.

The hollow support tube 12 includes an upper end 31 and a lower end 32. With reference to the orientation of the hollow quench stick tube 10 depicted in FIG. 1, the upper end 31 of hollow support tube 12 is connected to the lower end 20 of the hollow cooling tube 11. The hollow cooling tube 11 and hollow support tube 12 are aligned to correspondingly define a common pathway 33 within the hollow quench stick tube 10. Referring to FIG. 4, a central axis 34 of the hollow quench stick tube 10 further defines the common pathway 33. During operation, the common pathway 33 serves as an air path for directing a flow of supplied air.

Figure 5:
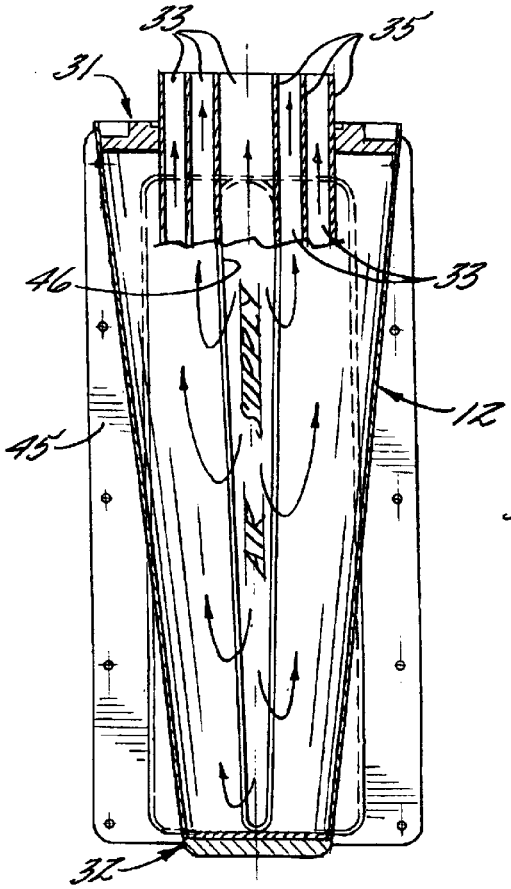
FIG. 5 is an enlarged partial side view taken along lines 5—5 of FIG. 4 illustrating a plurality of flow dividers housed within the hollow support tube that divert flowing air upwardly into the hollow cooling tube.

In a preferred embodiment, the hollow support tube 12 is substantially conical in shape as illustrated in FIGS. 1 and 5. The hollow support tube 12 incorporates a plurality of flow dividers 35 depicted in FIG. 4 that are capable of directing flowing air from the air supply upwards along the common pathway 33 into the hollow cooling tube 11. The plurality of flow dividers 35 is preferably formed of steel, aluminum, or similar hardened material of sufficient strength to withstand forces exerted by the flowing air. The flow dividers 35 are preferably secured to interior surfaces of the hollow support tube 12 and oriented in such a manner as to direct flowing air entering the hollow support tube into the hollow cooling tube 11. Accordingly, the flow dividers 35 may include a plurality of substantially circular vanes arranged in a concentric pattern.

Referring to FIG. 1, the finish applicator 13 substantially surrounds the hollow quench stick tube 10. As depicted, the finish applicator 13 is connected to the outer surface of the hollow quench stick tube 10. In a preferred embodiment, the finish applicator 13 is connected to the upper end 31 of the hollow support tube 12. Nevertheless, it will be understood that an alternative embodiment of the invention may include a finish applicator 13 that is connected to the lower end 20 of the hollow cooling tube 11. It will also be understood that the finish applicator 13 may be connected to the upper end 31 of the hollow support tube 12 and the lower end 20 of the hollow cooling tube 11. The finish applicator 13 may be secured to the hollow support tube 12 or hollow cooling tube 11 by any number of bolts, pins, or similar securing devices.

The finish applicator 13 is in communication with a supply of finishing agent via a conduit 36. The finish applicator 13 also defines a receptacle 40 for containing a desired amount of finishing agent, wherein the receptacle is in communication with the conduit 36. Accordingly, during operation, finishing agent is supplied to the finish applicator 13 via the conduit 36. The periphery of the finish applicator 13 includes an opening 41 that leads to the receptacle 40 such that finishing agent from the receptacle exits the opening and coats the filament stream 16 as the individual filaments contact the periphery of the finish applicator.

As illustrated in FIG. 4, the spoiler skirt 14 is substantially circular and surrounds the hollow quench stick tube 10. In a preferred embodiment, the spoiler skirt 14 is connected to the hollow quench stick tube 10. In a more preferred embodiment, the spoiler skirt 14 is connected to the hollow cooling tube 11. Nevertheless, it will be understood that the spoiler skirt 14 may be connected to the hollow support tube 12 or finish applicator 13 in an arrangement whereby the spoiler skirt substantially surrounds the hollow quench stick tube 10, yet does not interfere with the filament stream 16.

A preferred embodiment of the spoiler skirt 14 is preferably positioned above the finish applicator 13. Specifically, the spoiler skirt 14 is spaced apart from the finish applicator 13. The construction of the hollow quench stick tube 10 permits the spoiler skirt 14 and finish applicator 13 to define a spoiler void 42. As used herein, the spoiler void 42 is defined by the maximum diameter of the spoiler skirt 14, the maximum diameter of the finish applicator 13, and the periphery of the hollow quench stick tube 10.

With reference to the orientation of the invention as illustrated in FIG. 1, the spoiler skirt 14 flares outwardly from top to bottom forming a substantially smooth transition to alter the direction of the entrained air (i.e., flowing air drawn downwardly by the filament stream). Advantageously, the shape of the preferred embodiment of the spoiler skirt 14 facilitates the creation of a partial vacuum in the spoiler void 42. Specifically, the spoiler skirt 14 directs entrained air from a position adjacent the hollow quench stick tube 10 outwardly, against and through the filament stream 16, thereby creating an area of negative pressure (i.e., partial vacuum) between the bottom of the spoiler skirt and the top of the finish applicator 13. Test results indicate a reduction in pressure of approximately 1 to 5 millibars.

Specifically, the partial vacuum is created by two components of the entrained air acting in combination with ambient air. See FIG. 3. First, the flow of entrained air 43 that is forced through the filament stream 16 or wall (i.e., component one of the entrained air) creates a negative pressure in the spoiler void 42 immediately below the spoiler skirt 14. Second, the remaining entrained air 44 that fails to pass through the filament wall 16 (i.e., component two of the entrained air) accelerates through the narrowed opening between the maximum diameter of the spoiler skirt 14 and the filament wall. This second component of entrained air 44 accelerates as a result of the venturi effect. Stated differently, the narrowed opening between the maximum diameter of the spoiler skirt 14 and the filament wall 16 serves as a venturi to increase the speed of the entrained air 44, thus creating an area of negative pressure in the spoiler void 42. The resulting area of negative pressure (i.e., in the spoiler void 42) created by the entrained air 43, 44 draws ambient air into the spoiler void, thereby drawing the filament stream 16 inwardly and against the finish applicator 13.

This negative pressure creates a more stable spinning process by drawing the filament stream 16 towards the finish applicator 13 to thereby reduce the number of filaments oscillating against the finish applicator. The oscillating filaments 16 have intermittent contact with the finish applicator 13 and, thus, are less likely to receive a sufficient coating of finishing agent. By increasing the amount of surface area of each filament 16 that comes in contact with the finish applicator 13—and finishing agent—the present invention increases the amount of finishing agent applied to the filament. Thus, the invention produces filaments 16 having a more uniform finish distribution and are therefore protected from fiber damage during downstream processing.

In brief, the spoiler skirt 14 creates a divergence of entrained air against the filament stream 16 and a convergence of ambient air into the spoiler void 42. Advantageously, the partial vacuum created by the partial removal of the entrained air draws the filament stream 16 inward and against the finish applicator 13 such that the individual filaments are sufficiently lubricated with a desired finishing agent. It is known that insufficiently lubricated filaments tend to break or deform.

Further, the design of the spoiler skirt 14 minimizes reliance upon a filament guide or convergence device to assist in the finishing of the filament stream 16. More specifically, filament guides and convergence devices are generally used downstream to draw individual filaments towards one another and against a finish applicator 13. Nevertheless, known filament guides fail to reduce turbulence below the cooling tube that is created by entrained air. Turbulence, which is inherent with most conventional devices, causes filament vibration. The vibration oftentimes prevents some filaments from contacting the finish applicator 13.

Figure 8A:
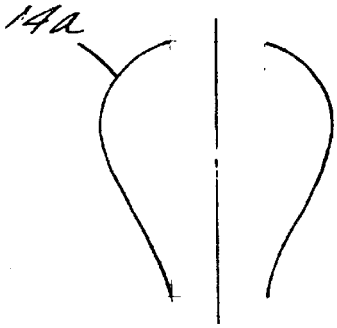
FIGS. 8A, 8B, 8C, and 8D are side views of alternative shapes of the spoiler skirt.
Figure 8B:
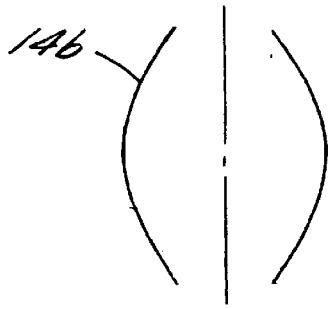
Figure 8C:
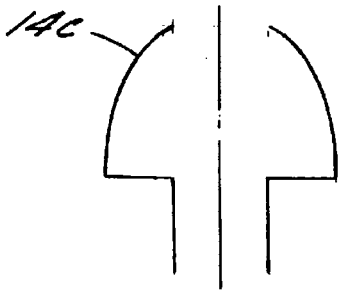
Figure 8D:
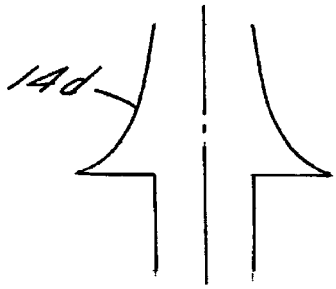

The incorporation of differential pressure to draw the filament stream 16 inward towards the hollow quench stick tube 10 and against the finish applicator 13 requires that the spoiler skirt 14 14C, 14D have an uppermost diameter that is less than the lowermost diameter. See FIGS. 1, 8C, and 8D. In other preferred embodiments, the uppermost diameter of the spoiler skirt 14, 14A, 14B, 14C, 14D is less than the maximum diameter of the spoiler skirt. See FIGS. 8A and 8B. In other words, the lower portion of the spoiler skirt 14 may taper inwardly, yet maintain a diameter that is less than the uppermost diameter.

The height of the spoiler skirt 14 is proportional to the angle of deflection of the spoiler skirt. Specifically, the ratio of the angle of deflection to skirt height in the preferred embodiment is between 1.35 to 2.78 degrees/inch. Trials indicate that as spoiler skirt 14 height decreases, the reduced surface area of the sides of spoiler skirt fails to deflect sufficient air flow to create a partial vacuum in the spoiler void 42. For example, a representative ratio of 6.14 degrees/inch results in a skirt having insufficient surface area to create a partial vacuum in the spoiler void 42. Similarly, as the deflection angle increases, the deflecting surface of the spoiler skirt 14 increases. As a result, the flowing air strikes a greater surface area and creates undesirable turbulent regions adjacent the filament stream.

Trials indicate that increasing the separation between the bottom of the skirt 14 and the top of the finish applicator 13 increases the differential pressure between the area immediately beneath the skirt (i.e., spoiler void 42) and the area beyond the perimeter of the bottom of the skirt (i.e., adjacent surroundings).

In mathematical terms, the preferred embodiment of the invention is configured such that the ratio of the lowermost diameter of the spoiler skirt 14 to the maximum diameter of the finish applicator 13 is between about 0.86 to 1.0.

Test trials conducted with the present invention identified process variables that influence the negative pressure generated under the spoiler skirt 14. Those process variables included wind-up speed, throughput, quench airflow, spinneret hole-count, and the distance between the bottom outside diameter of the spoiler skirt 14 and the top outside diameter of the finish applicator 13.

A spoiler skirt 14 having a top outside diameter of 4.5 inches and a bottom outside diameter of 6.5 inches was spaced above the finish applicator 13 at a distance of 1.5 inches and 2.5 inches, respectively. Tests incorporating a spinneret 50 having a 2250 hole-count indicated that distance between the bottom of the spoiler skirt 14 and top of the finish applicator 13, throughput, wind-up speed, and quench airflow significantly affected the negative pressure under the spoiler skirt.

Tests incorporating a spinneret 50 having a 3003 hole-count indicated that only the distance between the bottom of the spoiler skirt 14 and top of the finish applicator 13, and wind-up speed, significantly affected the pressure under the spoiler, skirt. All data collected indicated that the distance between the bottom of the spoiler skirt 14 and top of the finish applicator 13, wind-up speed, hole-count, quench airflow, and throughput significantly impacted the pressure under the skirt.

Based on stepwise regression data, the distance between the bottom of the spoiler skirt 14 and top of the finish applicator 13 and wind-up speed are the dominating variables that influence the pressure under the spoiler skirt. As the distance between the bottom of the spoiler skirt 14 and top of the finish applicator 13 increases, the volume of the spoiler void 42 increases, thereby providing a larger void in which the negative pressure is generated.

As wind-up speed increases during operation, the entrained airflow in the filament stream 16 increases, as well as the velocity of the flowing air. Observations confirmed that the spoiler skirt 14 creates a low-pressure region under the skirt when entrained air is deflected against and through the filament stream. As ambient air adjacent the spoiler void 42 moves to fill the low-pressure region under the skirt, the converging ambient air pulls the filaments inward and against the finish applicator 13.

The invention may also include a support fin 45 that is connected to the hollow support tube 12 as depicted in FIGS. 1 and 4. In a preferred embodiment, the support fin 45 is in communication with the air supply and the hollow support tube 12. Accordingly, the support fin 45 is in communication with the common pathway 33 (i.e., air path) and is capable of directing flowing air from an air supply along the hollow support tube 12 into the hollow cooling tube 11. As illustrated in FIG. 4, a preferred embodiment of the support fin 45 is triangular in shape. Specifically, the support fin 45 is defined by three sides, wherein two sides converge to form an edge connected to the hollow support tube 12 such that its shape is substantially triangular. It will be understood by those skilled in the art that the shape of the support fin 45 may be rectangular, circular, elliptical, or any shape that facilitates the delivery of supplied air, yet does not interfere with the movement of the filament stream. The support fin 45 may be substantially hollow to facilitate flowing air. Nevertheless, it will be understood that the support fin 45 may define a channel 46 or channels for directing air from the air supply into the hollow support tube 12.

A preferred embodiment of the invention also includes a spinneret 50 positioned above and substantially adjacent to the upper end of the hollow quench stick tube 10. See FIG. 1. Stated differently, the spinneret 50 is positioned above and substantially adjacent to the upper end 15 of the hollow cooling tube 11. The spinneret 50 is preferably coaxial with the common pathway 33 defined by the hollow support tube 12 and hollow cooling tube 11. During operation, the spinneret 50 provides a substantially circular filament stream 16 that flows downwardly and substantially surrounds the hollow quench stick tube 10.

Trial results of the present invention during operation verify the relationship between the volume of the spoiler void 42 and hole count of the spinneret 50. Expressed in mathematical terms, the ratio of the volume of the spoiler void 42 to the hole count of the spinneret 50 is between about 0.2 to 0.7 cubic centimeters per number of holes in the spinneret. In a preferred embodiment, the ratio of the volume of the spoiler void 42 to the hole count of said spinneret 50 is between about 0.3 and 0.5 cubic centimeters per number of holes in the spinneret. In a related matter, trials indicate that in the preferred embodiment of the present invention, the ratio of the outside diameter of the bottom of the spoiler skirt 14 to the diameter of the inner row of holes on the spinneret 50 is between 1.12 to 1.37.

Figure 6:
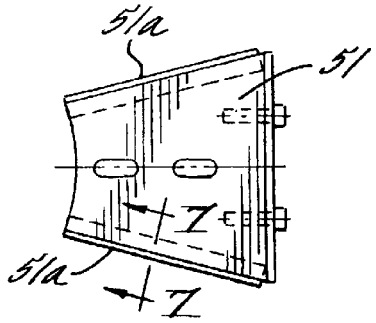
FIG. 6 is an enlarged top plan view of the filament guide.
Figure 7:
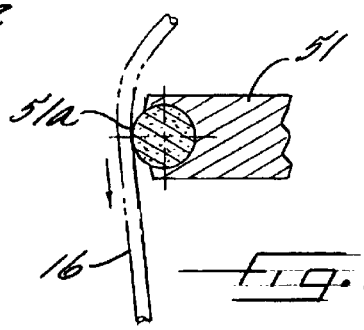
FIG. 7 is an enlarged partial view taken generally along lines 7—7 of FIG. 6 depicting the filament guide directing a filament around the support fin.

A filament guide 51 depicted in FIGS. 4, 6, and 7 may also be incorporated into the invention and positioned adjacent to the hollow quench stick tube 10. As configured, the filament guide 51 is positioned below and spaced apart from the finish applicator 13. Stated differently, the filament guide 51 is positioned substantially adjacent to the upper end 31 of the hollow support tube 12. In a preferred embodiment, the filament guide 51 is connected to an upper edge of the support fin 45 to direct the filament stream 16 around the support fin, thereby preventing the individual filaments from contacting the support fin. In an alternative embodiment, the filament guide 51 may be positioned substantially adjacent to the lower end of the hollow cooling tube 20. The exposed edges 51*a* of the filament guide 51 are preferably made of ceramic. Nevertheless, it will be understood that the filament guide 51 may be formed of any material that prevents the filament stream 16 from adhering to the filament guide.

The invention may also include a convergence device 52 shown in FIG. 1 that is positioned below and spaced from the hollow quench stick tube 10. The convergence device 52 is preferably positioned below and spaced from the hollow support tube 12. The convergence device 52 may include a ring or similar substantially circular device that directs the individual filaments of the filament stream 16 to a common point for collection on a winding unit.

Another aspect of the invention includes the use of the apparatus in conjunction with a method for cooling and finishing melt-spun filaments. In a preferred method, an apparatus is provided that includes a hollow quench stick tube 10, a finish applicator 13 that substantially surrounds the hollow quench stick tube, and a spoiler skirt 14 that substantially surrounds the hollow quench stick tube. The hollow quench stick tube 10 provided defines a plurality of openings 21 positioned along its periphery for dispersing a flow of supplied air. The hollow quench stick tube 10 further defines an air path within the hollow quench stick tube for directing the flowing air. The spoiler skirt 14 provided is positioned above and spaced apart from the finish applicator 13 to thereby define a spoiler void 42.

Upon providing the apparatus, a filament stream 16 is spun above an upper end of the hollow quench stick tube 10. Specifically, a stream of melt spun filaments is extruded above the hollow quench stick tube 10 in such a manner that the filament stream substantially surrounds the hollow quench stick tube. Stated differently, the spinneret 50 spins the filament stream 16 in a substantially circular pattern.

Next, a flow of supplied air is pumped into the hollow quench stick tube 10. Upon entering the hollow quench stick tube 10, the flowing air is directed upwardly along the air path by, for example, a plurality of flow dividers 35. Upon reaching the upper end of the hollow quench stick tube 10, the flowing air is dispersed through the plurality of openings 21. Upon exiting the openings 21, the air is directed against the filament stream 16. The downwardly moving filament stream 16 causes the flowing air to become entrained-i.e., the downwardly moving filament stream 16 draws the flowing air downwardly. The flowing air cools the filament stream 16 as it initially strikes the filament stream. Specifically, the majority of cooling occurs approximately ten inches below the point of extrusion.

Advantageously, the flowing air passing over the outer surface of the spoiler skirt 14 and adjacent the spoiler void 42 creates a negative pressure differential between the spoiler void and the adjacent surroundings. Specifically, the entrained air 43 that passes through the filament wall 16, and the entrained air 44 that passes through the narrow opening between the outer diameter of the spoiler skirt 14 and the filament wall (i.e., venturi), creates a negative pressure area in the spoiler void 42. As a result, ambient air is drawn into the spoiler void 42 having a negative pressure area. The flow of ambient air into the spoiler void 42 draws the filament stream 16 inwardly and against the finish applicator 13.

Finally, the filament stream 16 is finished with a desired agent. More specifically, the step of finishing includes applying a desired finishing agent to the filament stream 16. During the finishing step, filaments 16 are coated by a finishing agent provided by the finish applicator 13 when the filament stream is drawn inwardly into the spoiler void 42 and against the perimeter of the finish applicator.

As practiced, the method provides a pressure differential between the spoiler void 42 and the adjacent surrounding between about 1 to 5 millibars. Further, the velocity of the flowing air moving from an upper end of the hollow quench stick tube 10 to a lower end of the hollow quench stick tube is between about 75 and 315 per minute fpm). The method further provides for the cooling and finishing of the melt-spun filaments 16 at a draw ratio of between about 1.5 and 3.75.

In the drawings and specification, there have been disclosed typical embodiments on the invention and, although specific terms have been employed, they have been used in a generic and descriptive sense only and not for purposes of limitation, the scope of the invention being set forth in the following claims.

That which is claimed is:

1. An apparatus for cooling and finishing melt-spun filaments, comprising:

a hollow quench stick tube having an upper end and a lower end, said hollow quench stick tube formed of a hollow cooling tube and a hollow support tube;

said hollow cooling tube having an upper end and a lower end, said hollow cooling tube defining a plurality of openings positioned along its periphery for dispersing a flow of air;

said hollow support tube having an upper end and a lower end, said upper end of said hollow support tube being connected to said lower end of said hollow cooling tube, wherein said hollow cooling tube and said hollow support tube define a common pathway within said hollow quench stick tube;

a finish applicator substantially surrounding said hollow quench stick tube; and a spoiler skirt substantially surrounding said hollow quench stick tube, wherein said spoiler skirt is positioned above and spaced apart from said finish applicator to thereby define a spoiler void.

2. An apparatus according to claim 1, wherein said hollow quench stick tube is substantially circular.

3. An apparatus according to claim 1, wherein said hollow cooling tube comprises a dispersal sleeve, said dispersal sleeve substantially surrounding a portion of said hollow cooling tube.

4. An apparatus according to claim 3, wherein said dispersal sleeve is made from material selected from the group consisting of foam, wire, woven textile material, and non-woven textile material.

5. An apparatus according to claim 1, wherein said hollow quench stick tube further comprises a cover plate secured to said upper end of said hollow quench stick tube, said cover plate having a top surface and a bottom surface, wherein said cover plate seals said upper end of said hollow quench stick tube.

6. An apparatus according to claim 5, wherein said hollow quench stick tube further comprises an air director secured to said bottom surface of said cover plate, wherein said air director is capable of deflecting flowing air into said plurality of openings.

7. An apparatus according to claim 1, wherein said plurality of openings is positioned above said spoiler skirt.

8. An apparatus according to claim 1, wherein said hollow support tube is substantially conical in shape.

9. An apparatus according to claim 1, wherein said hollow support tube includes a plurality of flow dividers that are capable of directing a flow of supplied air upwards along said common pathway into said hollow cooling tube.

10. An apparatus according to claim 1, wherein said common pathway is defined by a central axis.

11. An apparatus according to claim 1, wherein said finish applicator is connected to said hollow quench stick tube.

12. An apparatus according to claim 1, wherein said finish applicator is connected to said upper end of said hollow support tube.

13. An apparatus according to claim 1, wherein said finish applicator is connected to said lower end of said hollow cooling tube.

14. An apparatus according to claim 1, wherein said finish applicator is connected to said upper end of said hollow support tube and said lower end of said hollow cooling tube.

15. An apparatus according to claim 1, wherein said spoiler skirt is substantially circular.

16. An apparatus according to claim 1, wherein said spoiler skirt is connected to said hollow quench stick tube.

17. An apparatus according to claim 1, wherein said spoiler skirt is connected to said hollow cooling tube.

18. An apparatus according to claim 1, wherein the uppermost diameter of said spoiler skirt is less than the lowermost diameter of said spoiler skirt.

19. An apparatus according to claim 18, wherein the ratio of the lowermost diameter of said spoiler skirt to the maximum diameter of said finish applicator is between about 0.86 to 1.0.

20. An apparatus according to claim 1, wherein the uppermost diameter of said spoiler skirt is less than the maximum diameter of said spoiler skirt.

21. An apparatus according to claim 20, wherein the ratio of the lowermost diameter of said spoiler skirt to the maximum diameter of said finish applicator is between about 0.86 to 1.0.

22. An apparatus according to claim 1, wherein the ratio of the angle of deflection of said spoiler skirt to the height of said spoiler skirt is between about 1.35 and 2.78 degrees/inch.

23. An apparatus according to claim 1, further comprising a support fin connected to said hollow support tube, said support fin in communication with said common pathway.

24. An apparatus according to claim 1, further comprising a spinneret positioned above and substantially adjacent to said upper end of said hollow quench stick tube.

25. An apparatus according to claim 24, wherein the ratio of the volume of the spoiler void to the hole count of said spinneret is between about 0.2 to 0.7 cubic centimeters per number of holes.

26. An apparatus according to claim 24, wherein the ratio of the volume of the spoiler void to the hole count of said spinneret is between about 0.3 and 0.5 cubic centimeters per number of holes.

27. An apparatus according to claim 1, further comprising a filament guide adjacent to said hollow quench stick tube, said filament guide positioned below and spaced apart from said finish applicator.

28. An apparatus according to claim 27, wherein said filament guide is positioned substantially adjacent to said upper end of said hollow support tube.

29. An apparatus according to claim 27, wherein said filament guide is positioned substantially adjacent to said lower end of said hollow cooling tube.

30. An apparatus according to claim 1, further comprising a convergence device positioned below and spaced from said hollow quench stick tube, wherein said convergence device is capable of combining filaments into a single thread.

31. An apparatus according to claim 30, wherein said convergence device is substantially circular.

32. An apparatus for cooling and finishing melt-spun filaments, comprising:

a substantially circular hollow cooling tube having an upper end and a lower end, said hollow cooling tube defining a plurality of openings positioned along its periphery for dispersing a flow of air;

a substantially conical hollow support tube having an upper end and a lower end, said upper end of said hollow support tube being connected to said lower end of said hollow cooling tube, said hollow support tube in communication with said hollow cooling tube;

a ring-shaped finish applicator substantially surrounding said upper end of said hollow support tube and connected to said lower end of said hollow cooling tube;

a substantially circular spoiler skirt substantially surrounding said hollow cooling tube, said spoiler skirt spaced from said finish applicator to thereby define a spoiler void; and a support fin connected to and in communication with said hollow support tube;

wherein said hollow cooling tube, said hollow support tube, said finish applicator, and said spoiler skirt are coaxial.

33. An apparatus according to claim 32, wherein said hollow cooling tube comprises a dispersal sleeve that substantially surrounds a portion of said hollow cooling tube, said dispersal sleeve adjacent said plurality of openings.

34. An apparatus according to claim 33, wherein said dispersal sleeve is made from material selected from the group consisting of foam, wire, woven textile material, and non-woven textile material.

35. An apparatus according to claim 32, wherein said hollow cooling tube further comprises a cover plate secured to said upper end of said hollow cooling tube, said cover plate having a top surface and a bottom surface, wherein said cover plate seals said upper end of said hollow cooling tube.

36. An apparatus according to claim 35, wherein said hollow cooling tube further comprises an air director secured to said bottom surface of said cover plate, wherein said air director is capable of deflecting flowing air into said plurality of openings.

37. An apparatus according to claim 32, wherein said plurality of openings is positioned above said spoiler skirt.

38. An apparatus according to claim 32, wherein said hollow support tube includes a plurality of flow dividers that are capable of directing a flow of supplied air from said support fin upwards into said hollow cooling tube.

39. An apparatus according to claim 32, wherein said spoiler skirt is connected to said hollow cooling tube.

40. An apparatus according to claim 32, wherein the uppermost diameter of said spoiler skirt is less than the lowermost diameter of said spoiler skirt.

41. An apparatus according to claim 40, wherein the ratio of the lowermost diameter of said spoiler skirt to the maximum diameter of said finish applicator is between about 0.86 to 1.0.

42. An apparatus according to claim 32, wherein the uppermost diameter of said spoiler skirt is less than the maximum diameter of said spoiler skirt.

43. An apparatus according to claim 42, wherein the ratio of the lowermost diameter of said spoiler skirt to the maximum diameter of said finish applicator is between about 0.86 to 1.0.

44. An apparatus according to claim 32, wherein the ratio of the angle of deflection of said spoiler skirt to the height of said spoiler skirt is between about 1.35 and 2.78 degrees/inch.

45. An apparatus according to claim 32, wherein said support fin having three sides, wherein two sides converge to define an edge connected to said hollow support tube such that its shape is substantially triangular.

46. An apparatus according to claim 32, further comprising a spinneret positioned above said upper end of said hollow cooling tube, said spinneret coaxial with said hollow cooling tube.

47. An apparatus according to claim 46, wherein the ratio of the volume of the spoiler void to the hole count of said spinneret is between about 0.2 to 0.7 cubic centimeters per number of holes.

48. An apparatus according to claim 46, wherein the ratio of the volume of the spoiler void to the hole count of said spinneret is between about 0.3 and 0.5 cubic centimeters per number of holes.

49. An apparatus according to claim 32, further comprising an air supply positioned adjacent to and in communication with said support fin.

50. An apparatus according to claim 49, wherein said hollow cooling tube, said hollow support tube, and said support fin define an air path that directs air from said air supply into said hollow cooling tube.

51. An apparatus according to claim 32, further comprising a filament guide connected to a top surface of said support fin.

52. An apparatus according to claim 32, further comprising a substantially circular convergence device positioned below and spaced apart from said hollow support tube, wherein said convergence device is capable of combining filaments into a single thread.

* * * * *